United States Patent [19]

Woodhams

[11] 4,265,060

[45] May 5, 1981

[54] VENTILATION BAFFLE

[76] Inventor: Edward J. Woodhams, 134 Crooked Lake Dr., Kalamazoo, Mich. 49009

[21] Appl. No.: 55,338

[22] Filed: Jul. 6, 1979

[51] Int. Cl.[3] ..... E04B 7/02; F24F 7/00

[52] U.S. Cl. ..... 52/92; 52/95; 52/198; 98/37; 98/DIG. 6

[58] Field of Search ..... 52/95, 92, 198; 98/32, 98/37, DIG. 6

[56] References Cited

U.S. PATENT DOCUMENTS

| | | | |
|---|---|---|---|
| 3,160,987 | 12/1964 | Pinkley | 52/95 |
| 3,863,553 | 2/1975 | Koontz | 52/198 X |
| 4,069,628 | 1/1978 | Kreimer | 52/94 |
| 4,185,433 | 1/1980 | Cantrell | 52/94 X |

*Primary Examiner*—Alfred C. Perham

*Attorney, Agent, or Firm*—Blanchard, Flynn, Thiel, Boutell & Tanis

[57] ABSTRACT

Temperature equalizing means for roofs. Means are provided for containing and controlling ceiling insulation so as to provide adequate air-flow communication between a first zone defined between the ceiling and the roof of a building and a second zone defined between projecting eaves of said building and soffits immediately thereunder. Such communication maintains the roof at a more nearly uniform temperature across the entire width of the roof so that during cold weather melting of snow on the roof is minimized and thereby the build-up of a ridge of ice along the eaves caused by freezing of melted snow is minimized and, consequently, leakage of melted ice under the shingles and through said roof is prevented. The device comprises a channel-shaped member positionable between the rafters of the building and spaced from the inside surface of the roof boards whereby communication between said first and second zones is not blocked by the installation of insulation on said ceiling.

2 Claims, 4 Drawing Figures

VENTILATION BAFFLE

FIELD OF THE INVENTION

The invention relates to means for preventing the buildup of ice along the eaves of a building and thereby preventing resultant leakage of melted ice under the shingles and through the roof of such building. The invention comprises particularly means for maintaining a channel of air-flow communication between a first zone immediately under such roof and a second zone between the eaves and the soffit associated therewith.

BACKGROUND OF THE INVENTION

In conventional frame building construction, there is frequently provided a soffit which extends substantially horizontally from the outer wall of such building to the outer edges of its eaves. There is also normally provided between the lower surface of the roof of such building and the upper edge of the wall thereof passages between the roof rafters which provide communication between a first zone immediately under the roof thereof and a second zone defined between the projecting eaves and the soffit. This communication permits at least a small amount of outside air to move into the zone between the eaves and the soffit and to move from that zone into the zone under the roof. Also, there is or are provided one or more ventilating openings near the peak of the roof for allowing relatively warm air to escape. Thus, in cold weather, relatively warm air that rises toward the peak of the roof can become mixed with cooler outside air that flows through the passages, thereby to maintain a more uniform cooler temperature across the entire width of the roof. However, when the buiding is insulated by placing a layer of insulation on top of the ceiling of whatever living space is provided below the zone immediately under such roof, these openings are often blocked and outside air is no longer permitted to flow from the zone between the eaves and soffit into the zone directly under the roof. Thus, in cold weather, because room heat that flows upwardly through the insulation tends to accumulate toward the peak of the roof, melting of snow will occur thereat, such melted snow will flow down along the roof and will often freeze as it reaches the outer edge of the eaves which are unheated. Consequently a ridge of ice builds up along the eaves and as subsequent melting occurs, the thawed ice on the eaves often flows back under the shingles of said roof and causes leakage through the ceiling above mentioned and/or into the inside of the building wall.

This problem is well known and has long been recognized and numerous devices have been provided in an attempt to correct same. One particularly common means for accomplishing this purpose is to provide a resistance heating wire along the edge of said eaves, or a resistance wire describing a circuitous pattern immediately back from the edge of such eaves, in order to prevent the formation of ice thereon. This system works well but it is both expensive to install and requires the constant use during cold weather of a substantial amount of electrical energy.

Other means have also been provided but insofar as I am aware, they have all either been even more expensive to install and/or operate than the resistance wire means above-mentioned or they have been insufficiently effective to be satisfactory.

Accordingly, the objects of the invention include:

1. To provide means for preventing insulation installed above a ceiling from blocking air flow between a first zone under said roof and a second zone between the projecting eaves of such building and a soffit associated therewith, so that cool outside air can flow into said first zone to maintain the roof at a more uniform cooler temperature across its entire width in order to minimize melting of snow thereon.

2. To provide means, as aforesaid, for maintaining a channel of air flow communication past insulation between said first zone and said second zone.

3. To provide inexpensive means, as aforesaid, which may be installed between roof rafters during the application of ceiling insulation for preventing such insulation from blocking air flow communication between said first and second zones but instead insuring a continuous channel of air flow communication therebetween.

4. To provide a device, as aforesaid, which will be sufficiently inexpensive as not to add materially to the cost of the insulation job.

5. To provide a device, as aforesaid, which can be installed readily and quickly by simple means and at the same time as the insulation and will thereby not add materially if at all to the labor cost of an insulation job.

6. To provide a device, as aforesaid which will easily last as long as the insulation and/or the building and hence not require repair or renewal during the normal life of either the insulation or of the building.

7. To provide a device, as aforesaid, wherein the manner of installation can be readily explained to workmen installing such insulation and which will not require special equipment or tools for the installation of such device.

8. To provide a device, as aforesaid, which can be installed as required by means of the same tools as utilized for installing the insulation.

Other purposes and objects of the invention will be apparent to persons acquainted with devices of this general type upon reading the following specification and inspection of the accompanying drawings.

DETAILED DESCRIPTION

Figure 2:
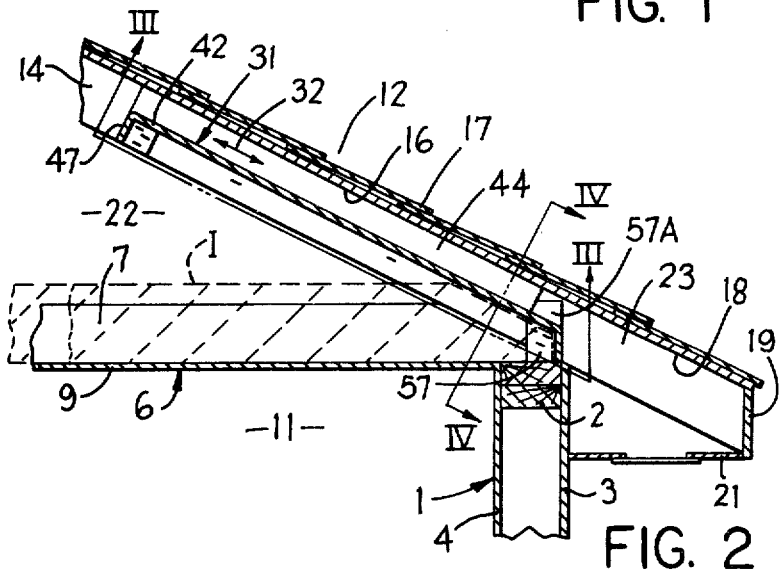
FIG. 2 is a vertical sectional view through a roof, wall and ceiling showing the device of the invention installed into position.
Figure 3:
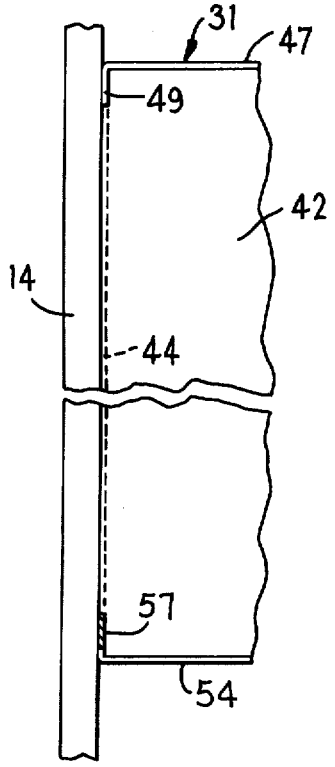
FIG. 3 is a sectional fragmentary view taken on the line III—III of FIG. 2.

Referring now to the drawings, there is shown in FIG. 2 a conventional wall structure 1 having in this illustration a conventional upper plate 2, an outer wall panel 3 and an inner wall panel 4. Above said walls, there is provided a conventional ceiling 6 comprising the usual plurality of parallel rafters of which two appear at 7 and 8 together with a single or multilayer bottom panel 9 comprising the ceiling of the living space 11.

Positioned above such ceiling structure 6 is a conventionally constructed roof 12, here comprising a plurality of parallel rafters of which two appear at 13 and 14 and a roof panel 16 which may be single or multi-layer as desired. Said roof panel is then covered by conventional shingles 17 in the usual manner, which shingles may be wood or composition of any ordinary nature or type without changing the applicability of the invention. The eaves indicated at 18 project beyond the building wall 1 in a normal manner; a facia 19 extends downwardly from the outer edge of the roof panel 16 and a soffit 21 extends from the facia 19 to the outer wall panel 3 to close the space therebetween.

The foregoing describes the usual frame construction of a roof and ceiling construction immediately above an outer wall of a frame building. In the absence of insulation, the zone above the plate 2 and between the rafters, such as between the rafters 13 and 14, provides for sufficient communication between a first zone 22 between the roof 12 and the ceiling 6 and a second zone 23 between the eaves 18 and the soffit 21 as to insure that outside air can flow into second zone 23 and thence into zone 22 to mix with relatively heated air therein and maintain the internal surface of the roof 12 at a more uniform, relatively cooler temperature across its entire width. Thus, the inner and outer surfaces of the roof are at more nearly equal temperatures which is effective to minimize melting of the lower surface of the layer of snow on the roof caused by room heat from the building. This, in turn, minimizes build-up of ice dams on the eaves caused by freezing of melted snow when it flows above the eaves.

However, when insulation, such as the insulation I is installed above the ceiling 6 and between the joists such as the rafters 7 and 8 thereof, such insulation will often block such communication zones and prevent the outside air flow from the second zone 23 into the first zone 22. Thus, heat escaping from the upper surface of the insulation I flows upwardly to contact and heat the inner surface of the roof. Under appropriate weather conditions and snow loads, this heat will melt the lower surface of the snow adjacent the roof surface, the water will flow down to the eaves and will be frozen thereat so that a ridge of ice will build up on the outer edge of the eaves.

All of the foregoing is well-known and is set forth in detail only to set forth clearly the environment in which the invention is used and insure an understanding of its manner of operation.

Figure 4:
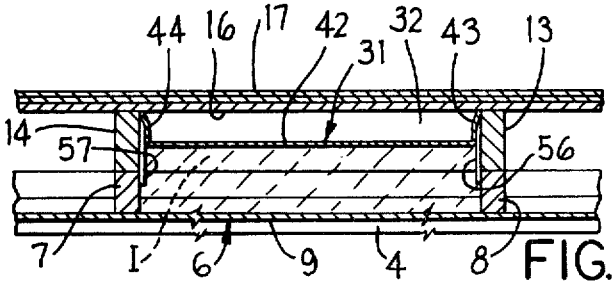
FIG. 4 is a sectional view taken on the line IV—IV of FIG. 2.

Turning now to the means comprising the invention, there is provided a retainer member 31 for installation between the rafters such as between the rafters 13 and 14 as shown best in FIG. 4. This retainer member is fixed between said rafters, as aforesaid, prevents the movement of the insulation I into position closing the zone between said rafters and hence prevents the blocking of communication between the first zone 22 and the second zone 23. Alternatively stated, the retainer 31 maintains a passageway 32 to insure continued communication from said first zone 22 to the second zone 23.

Figure 1:
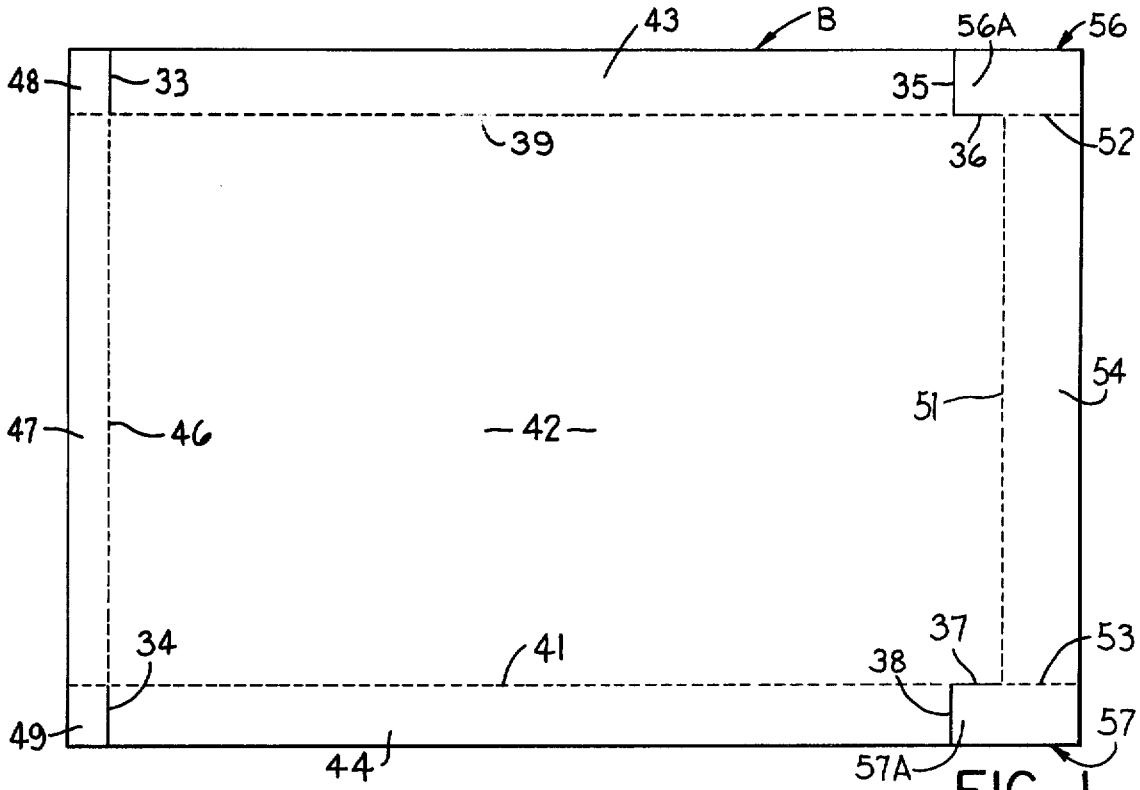
FIG. 1 is a top view of a blank from which may be formed the device of the invention.

While said retainer 31 may be formed in any of several specific ways, one preferred way is indicated by FIG. 1 which illustrates a blank B from which a suitable such retainer may be formed. Said blank B is provided with fold lines as indicated by the dotted lines in FIG. 1 and is provided with cuts as indicated by the solid lines 33–38 in FIG. 1.

Folding of said blank B on the dotted lines 39 and 41 forms a retainer having a bottom member 42 and upwardly extending sides 43 and 44. Folding on the fold line 46 provides a downwardly extending end wall 47 and stapling or otherwise fastening of the tabs 48 and 49 effects stiffening of the structure. However, the stiffening structure represented by the end wall 47 and the tabs 48 and 49 may be eliminated, if desired, to reduce the expense of the device and same will still function effectively.

Folding on the fold line 51, and folding on the fold lines 52 and 53 if same have not already been folded, provides a downwardly extending end wall 54 and upright tabs 56 and 57. Said tabs 56 and 57 project downwardly as shown in FIG. 2 and provide for the support of the retainer member 31 on the upper surface of the upper plate 2. They also project upwardly substantially into abutment with the roof deck 16.

With the parts folded as above described, same may be fixed into the box-shape thus provided in any convenient manner, such as by gluing or stapling. Said retainer member is then positioned between a pair of rafters with its bottom member 42 sufficiently spaced downwardly from the roof panel 16 as to provide the passageway 32 and said retainer member may then be fastened to said rafters in any convenient manner, such as by stapling. The space between as many pairs of rafters as desired may be provided with retainer members in the manner above described according to the amount of communication it is desired to maintain between the first and second zones 22 and 23. However, it will normally be preferred to have a retainer member as described placed between each pair of rafters along the full length of each side of the building concerned in order that this communication may be maintained at a maximum level and the tendency for ice to form along the outer edges of the eaves will be minimized.

The retainer member may be made of any desired sheet material but an inexpensive corrugated paper board will be effective in all usual situations.

In use, outside air under positive air pressure, such as caused by atmospheric wind, will enter through openings in soffit 27 into the zone 23. The outside air will then flow through passages 32 along the underside of the roof deck 16 into the zone 22. The flow of air keeps the roof deck 16 at a temperature as close as possible to the outside temperature and thus minimizes melting of the bottom surface layer of any snow that is present on the roof.

By bending flange 54 and flanges 43 and 41, as needed, about their respective fold lines 51, 39 and 41, variations in rafter spacing and roof pitch can be accommodated. Further, because the lower edge of flange 57 rests on upper plate 2, said flange and thus the rest of the retainer member 31 cannot be pushed outwardly. Thus, the retainer member is self-adjusting and self-locking in position.

The national interest in saving energy is critical. Every means or maintaining or increasing the efficiency of household heating to cut down energy consumption must be utilized.

The extension of the usable life of a home without expensive repairs is also in the national interest.

This invention will contribute to both these objectives by helping to eliminate moisture in the attic space. It keeps the insulation dry and much more efficient in saving fuel. By helping to eliminate ice dams along roof eaves it extends the life of the building with fewer expensive repairs.

This invention assures adequate ventilation space between the insulation and the roof deck at the juncture where attic space joins the space in the overhang of the roof structure. It is unique in that while insuring proper ventilation it gives 100% closure below the ventilation space to keep insulation particles from falling or blowing into the overhang space and thereby prevents clogging of the flat screened openings in the soffit panels. It is also unique in that the design allows for automatic adjustment to any roof pitch. It is unique in that variance of spacing between roof rafters can be easily accommodated.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An insulation stop and ventilation baffle for minimizing ice accumulation on the eaves of a ceiling-insulated building wherein the building comprises upstanding walls having a horizontal top plate, horizontal ceiling joists having a ceiling affixed to the undersides thereof, roof rafters inclined upwardly from said ceiling joists and having roof sheathing affixed to the tops of said roof rafters, the space between said ceiling and said roof sheathing defining an attic, said ceiling joists and said roof rafters extending to said top plate and being affixed thereto, said roof rafters extending outwardly beyond said top plate to form eaves so that the attic and the eaves communicate by means of openings defined between adjacent roof rafters, said baffle comprising an elongated generally rectangular retainer member of stiff material, said retainer member having a pair of longitudially extending, parallel, fold lines respectively located close to the opposite lateral edges of said retainer member to divide said retainer member into a rectangular central portion and a pair of rectangular lateral edge portions on opposite sides of said central portion so that said lateral edge portions of said retainer member can be bent upwardly relative to said central portion to form upstanding sides positionable adjacent the opposing surfaces of a pair of adjacent roof rafters and extending substantially into contact with the lower surface of said roof sheathing whereby to position said central portion substantially parallel with and spaced a fixed distance downwardly from the lower surface of said roof sheathing thereby to define an air-flow passageway which is open at both its ends, said retainer member having an outer transversely extending fold line located close to the outer longitudinal end of said retainer member and defining an outer rectangular end portion so that said outer end portion can be positioned at the juncture of said roof rafters and ceiling joists above said top plate and can be bent downwardly relative to said central portion to define an outer downwardly extending end wall between the opposing surfaces of a pair of adjacent roof rafters and extending downwardly from said central portion substantially into contact with said top plate, a pair of rectangular outer tabs formed at the outer ends of said lateral edge portions of said retainer member adjacent said outer rectangular end portion, each of said outer tabs being defined by an outer transversely extending cut line spaced longitudinally inwardly from said outer transversely extending fold line and extending between the adjacent longitudinal edge of said retainer member and the adjacent longitudinally extending fold line, a longitudinally extending cut line extending longitudinally from the inner end of said outer transversely extending cut line to said outer transversely extending fold line and an outer tab fold line extending longitudinally from said outer transversely extending fold line to the adjacent outer end edge of said retainer member, said longitudinally extending cut line and said outer tab fold line being longitudinally aligned with and constituting extensions of said longitudinally extending fold line for said lateral edge portion so that said tabs can be bent into upright positions wherein they extend between said top plate and the lower surface of said sheathing and substantially parallel with said lateral edge portions.

2. An insulation stop and ventilation baffle as claimed in claim 1 including an inner transversely extending fold line located close to the inner end of said retainer member and defining an inner rectangular end portion which extends downwardly to form an inner downwardly extending end wall between the opposing surfaces of a pair of adjacent roof rafters, a pair of rectangular inner tabs formed at the inner ends of said lateral edge portions of said retainer member adjacent said inner rectangular end portion, each of said inner tabs being defined by an inner transversely extending cut line aligned with said inner transversely extending fold line and extending between the adjacent longitudinal edge of said retainer member and the adjacent longitudinally extending fold line, an inner tab fold line extending longitudinally from said inner transversely extending cut line to the adjacent inner end edge of said retainer member, said inner tab fold line being aligned with and constituting an extension of said longitudinally extending fold line for said lateral edge portion so that said inner tabs can be bent downwardly parallel with said lateral edge portions.

* * * * *